United States Patent [19]

McLaughlin

[11] Patent Number: 4,837,887

[45] Date of Patent: Jun. 13, 1989

[54] POWER CLEANING APPARATUS

[76] Inventor: Thomas L. McLaughlin, 516 Sidney St., Greensburg, Pa. 15601

[21] Appl. No.: 151,542

[22] Filed: Feb. 2, 1988

[51] Int. Cl.[4] ..... B08B 9/02

[52] U.S. Cl. ..... 15/104.33

[58] Field of Search ..... 15/104.33, 104.16; 254/134.3 FT

[56] References Cited

U.S. PATENT DOCUMENTS

| | | | |
|---|---|---|---|
| 1,851,766 | 3/1932 | Hotchkiss, Jr. | 15/104.33 |
| 2,042,407 | 5/1936 | Kugelman | 15/104.33 |
| 2,117,659 | 5/1938 | Gobatti | 15/104.33 |
| 2,470,225 | 5/1949 | Silverman | 15/104.33 |
| 2,887,703 | 5/1959 | Williams | 15/104.33 |
| 2,961,675 | 11/1960 | Stickney | 15/104.33 |
| 3,121,244 | 2/1964 | Hunt | 15/104.33 |
| 3,268,937 | 8/1966 | Bollinger | 15/104.33 |
| 3,283,353 | 11/1966 | Kirk | 15/104.33 |
| 3,445,879 | 5/1969 | Taylor | 15/104.1 |
| 3,574,878 | 4/1971 | Shames | 15/104.33 |
| 3,897,602 | 8/1975 | Waterbury | 15/104.33 |
| 4,364,140 | 12/1982 | Irwin | 15/104.33 |

FOREIGN PATENT DOCUMENTS

| | | | |
|---|---|---|---|
| 705644 | 5/1941 | Fed. Rep. of Germany | 15/104.33 |
| 1139785 | 2/1957 | France | 15/104.33 |

*Primary Examiner*—Edward L. Roberts

*Attorney, Agent, or Firm*—H. Keith Hauger

[57] ABSTRACT

A power cleaning apparatus featuring an elongated coil with a brush attached to one end thereof and a series of tubes that act as guides and prevent snarling during operation. The entire apparatus may be coiled in a unique configuration for convenient display and safe storage.

5 Claims, 2 Drawing Sheets

POWER CLEANING APPARATUS

BACKGROUND OF THE INVENTION

1. Field of the Invention

This invention relates to a power-cleaning apparatus for use in cleaning, removing and dislodging obstructions in clogged pipes, drains, thermos bottles and other like conduits.

2. Description of the Prior Art

The art of using power-driven snakes to clean sewer lines and other obstructed conduits is well known. The professional plumber is skilled with the use of these tools, which often cause whipping and snarling motion, but the individual homeowner may not possess this capability. There is a demand for a tool that can be easily used by individual homeowners and tenants to clean tub drains, sink drains and lines, vessels and other common lines and drains that are attached to kitchen and bathroom fixtures.

U.S. Pat. No. 2,887,703 to Williams consists of a long, flexible steel spring used to clean toilets and other plumbing devices. It permits the user to handle a flexible coil spring and yet, through a rigid barrel, permits elongation of the auger. An auger is generally understood to be a tool consisting of a shank with spiral channels ending in two hooks.

U.S. Pat. No. 2,961,675 to Stickney is a conduit cleaning device consisting of a rigid conduit and resilient tubular auger guide which slides through said conduit. Same is operated with a handle and crank that extends axially therethrough. The end of the auger is a helically coiled hook. The operator of this tool is able to reverse the direction of the auger.

U.S Pat. No. 3,121,244 to Hunt is a closet auger that is hand operated consisiting of a casing having a curved portion wherein a flexible snake moves with a wire head. A snake is extended or retracted through the casing.

U.S. Pat. No. 3,283,353 to Kirk consists of an auger head that is a spring of wider or greater diameter than the snake which is power driven by use of an adapter. A wooden grip is used as a guide. This tool is coiled in standard fashion for storage.

U.S. Pat. No. 3,445,879 to Taylor is a complex piece of equipment that is used to clean fragile, flexible hoses like vacuum cleaner hoses. It consists of an elongated, flexible guide sheath with a guard member on the end surrounding an obstruction-engaging member which is attached to a rotating, flexible cable. A compression spring and handle are used to import pressure to the obstruction-engaging member.

U.S. Pat. No. 3,574,878 to Shames is a helical wire-type power-driven snake used primarily in sewers and drains. It features a safety clutch that prevents damage to the snake or power tool.

SUMMARY OF THE INVENTION

It is, therefore, an object of the present invention to provide a conduit cleaning apparatus that is inexpensive, safe to use and of simple construction.

It is the further object of this invention to provide a conduit cleaning apparatus that is connected to a power tool for actuating same and removing impediments.

It is the further object of this invention to provide a powered conduit cleaning apparatus that may be easily adjusted to different lengths by use of a plurality of guide means.

It is the further object of this invention to provide a powered conduit cleaning apparatus that is easy for the homeowner to operate.

It is the further object of this invention to provide a powered conduit cleaning apparatus that has a high torque strength and concurrently has an efficient means to prevent snarling.

It is the further object of this invention to provide a powered conduit cleaning apparatus that is easy to remove in the event same sticks or lodges in a conduit.

It is the further object of the invention to provide a powered conduit cleaning apparatus that combines all the components into a unique unitized configuration for convenient display and self-contained safety storage.

It is the further object of the invention to provide a powered conduit cleaning apparatus that is capable of cleaning sediment build-up inside a conduit in addition to removing impediments.

More specifically, the present invention is a power conduit cleaning apparatus for use in cleaning, removing and dislodging obstructions in pipes, drains, thermos bottles and other like conduits comprising a flexible drive means having drive and driven ends; a cleaning means fixed to said driven end; a rotational power means engaged to said drive end for axial rotation of said flexible drive means and said cleaning means, a guide means capable of surrounding variable lengths of said flexible drive means during operation to prevent snarling and provide safety.

These objects, as well as other objects and advantages of the present invention, will become apparent from the following description, in reference to the illustrations appended hereto.

BRIEF DESCRIPTION OF THE DRAWINGS

For a better understanding of the invention, reference may be had to the accompanying drawings, in which.

DESCRIPTION OF PREFERRED EMBODIMENTS

Figure 1:
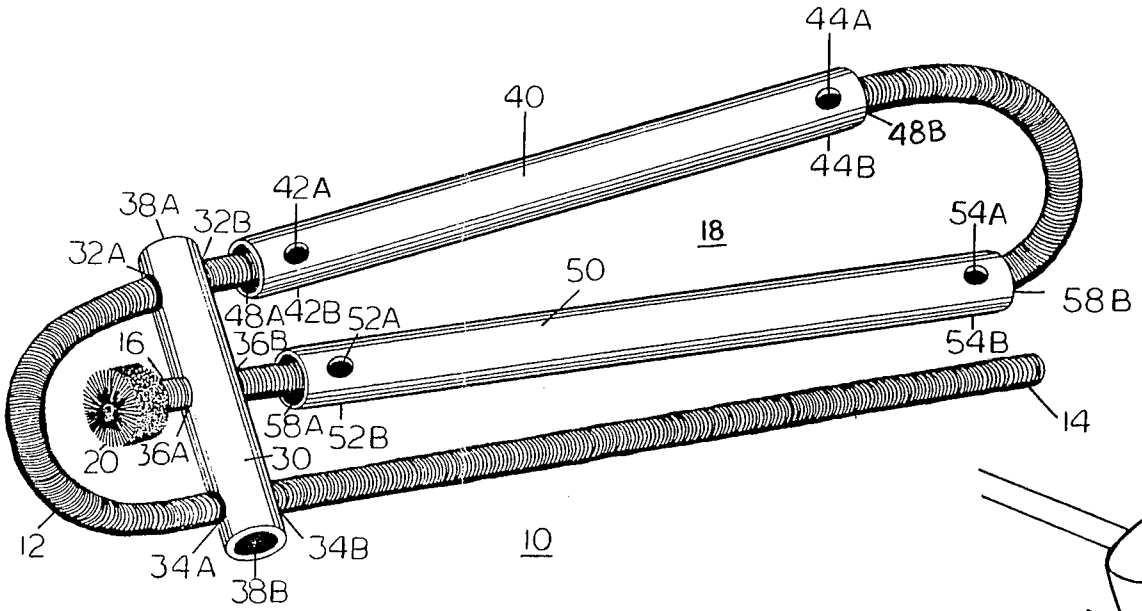
FIG. 1 is a perspective view of a powered conduit cleaning apparatus in its display or storage configuration.
Figure 2:
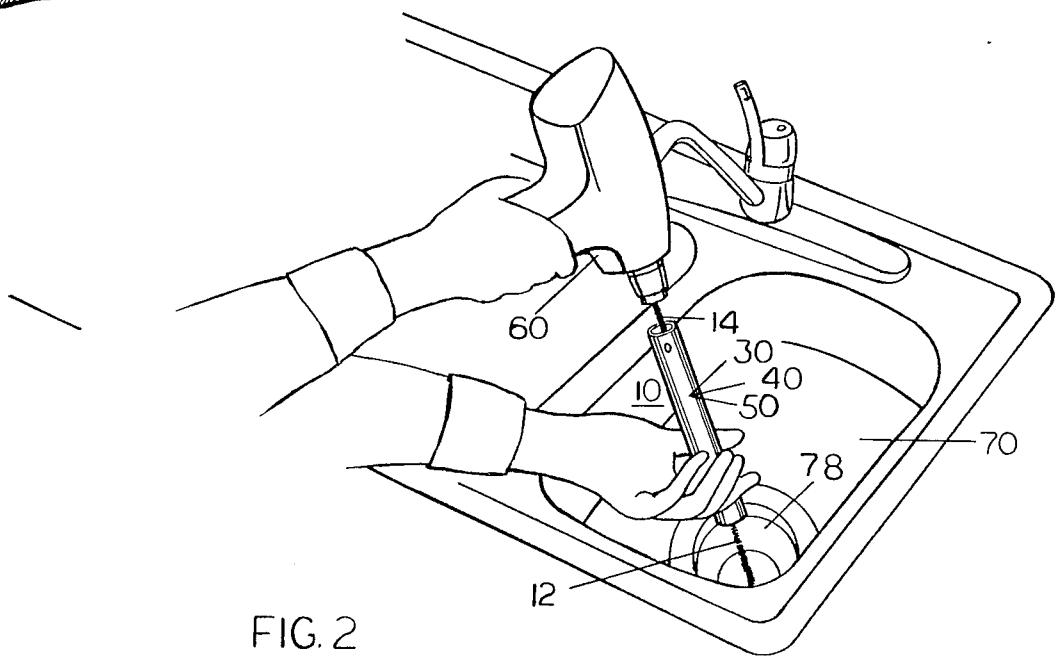
FIG. 2 represents a perspective view of a powered conduit cleaning apparatus being placed into position for use.
Figure 3:
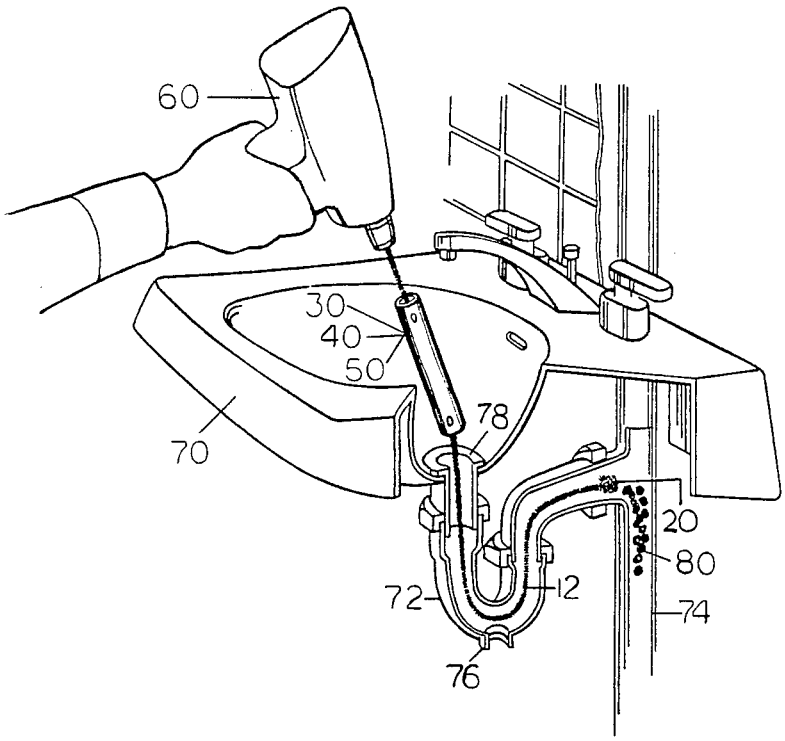
FIG. 3 represents a side elevation view of a powered conduit cleaning apparatus indicating an impediment in a drain conduit.

Referring to the drawings, FIG. 1 is a perspective view of a power conduit cleaning apparatus 10, having coil member 12 preferably made of coiled stainless steel, and being of variable length. Coil member 12 has drive end 14 for engagement to rotary power tool 60 as shown in FIGS. 2 and 3. Further, coil member 12 has driven end 16 for attachment thereto of cleaning member 20. Cleaning member 20 is preferably a stainless steel brush and is crimped to coil member 12 at driven end 16 but cleaning member 20 may be constructed of other materials like nylon for use against less durable materials including plastic conduits or thermos bottles, although it is not recommended that conduit cleaning apparatus 10 be used against a fragile material such as glass.

FIG. 1 shows power conduit cleaning apparatus 10 in its storage or display configuration 18. First coil guide means 30 functions to position coil member 12 in its storage or display configuration 18. First coil guide means 30 has therein aperture 32A and diametrically opposing aperture 32B, aperture 34A and diametrically opposing aperture 34B and aperture 36A and diametrically opposing aperture 36B all for receiving coil member 12. First coil guide means 30 may be retrieved in the event first coil means 30 accidentally falls into trap 72 or drain pipe 74 by use of a hook (not shown) which would catch to apertures 32A, 32B, 34A, 34B, 36A and 36B. First coil guide means 30 functions further to receive coil member 12 at aperture 38A and aperture 38B when first coil guide means 30 is used as a guide means as illustrated in FIGS. 2 and 6. Coil member 30 is preferably made of 400 P.S.I. ASTM plastic tube but may also be made of other tubular materials like stainless steel.

Second coil guide means 40 functions to position coil member 12 in its storage or display configuration 18. Second coil guide means 40 has therein aperture 42A and diametrically opposing aperture 42B (not visible), aperture 44A and diametrically opposing aperture 44B (not visible). Second coil guide means 40 may be retrieved in the event second coil guide means 40 accidentally falls into trap 72 or drain pipe 74 by use of a hook means (not shown) which would catch to aperture 42A, 42B, 44A, 44B. Second coil guide means 40 functions further to receive coil member 12 at aperture 48A and aperture 48B when second coil guide means is used as a guide means as illustrated in FIGS. 2 and 3. Coil member 40 is preferably made of 400 P.S.I. ASTM plastic tube but may also be made of other tubular materials like stainless steel.

Third coil guide means 50 functions to position coil member 12 in its storage or display configuration 18. Third coil guide means 50 has therein aperture 52A and diametrically opposing aperture 52B (not visible), aperture 54A and diametrically opposing aperture 54B (not visible). Third coil guide means 50 may be retrieved in the event third coil guide means 50 accidentally falls into trap 72 or drain pipe 74 by use of hook means (not shown) which would catch to aperture 52A, 52B, 54A and 54B. Third coil guide means 50 functions further to receive coil member 12 at aperture 58A and aperture 58B when third coil guide means is used as a guide means as illustrated in FIG. 2 and 3. Coil member 50 is preferably made of 400 P.S.I. ASTM plastic tube but may also be made of other tubular materials like stainless steel.

To achieve configuration 18 as shown in FIG. 1, coil member 12 is fed through aperture 36A and 36B of first coil guide means 30. Coil member 12 is then fed through third coil guide means 50 lengthwise at aperture 58A and 58B and second coil guide meand 40 by at aperture 48B and 48A. Drive end 14 of coil member 12 is then fed through aperture 32B and 32A of first coil guide means 30 and aperture 34A and 34B of first coil guide means 30. Configuration 18 makes it easy to display or store powered conduit apparatus 10.

FIG. 2 represents an illustration of rotary power tool 60 connected to powered conduit cleaning apparatus 10 at drive end 14. Typical use of power conduit cleaning apparatus 10 is for cleaning out a drain pipe 74 (FIG. 3) of sink 70 through feeding coil member 12 into drain aperture 78. First coil guide means 30, second coil guide means 40 and third coil guide means 50 are used for multiple purposes including guiding coil member 12 into drain aperture 78, preventing coil member 12 from whipping or snarling and to determine the depth of penetration of coil member 12. First coil guide means 30, second coil guide means 40 and third coil guide means 50 are slipped over coil member 12 prior to engagement of rotary power tool 60 at drive end 14. First coil guide means 30 is shorter in length than second coil guide means 40 which is shorter in length than third coil guide means 50. Thus, first coil guide means 30, second coil guide means 40 and third coil guide means 50 may each be used individually to determine the length of penetration of coil member 12 into trap 72 and drain pipe 74.

Rotary power tool 60 causes rotation of coil member 12 of which cleaning member 20 is a component. This rotary motion causes the removal of impediment 80 which may be located either in trap 72 or drain pipe 74 or both. In some instances, access to trap 72 or drain pipe 74 may be made through service aperture 76. The same procedure as previously outlined would be applicable i.e. feed coil member 12 into service aperture 76 using one of first coil guide means 30, second coil guide means 40 or third coil guide means 50.

Figure 4:
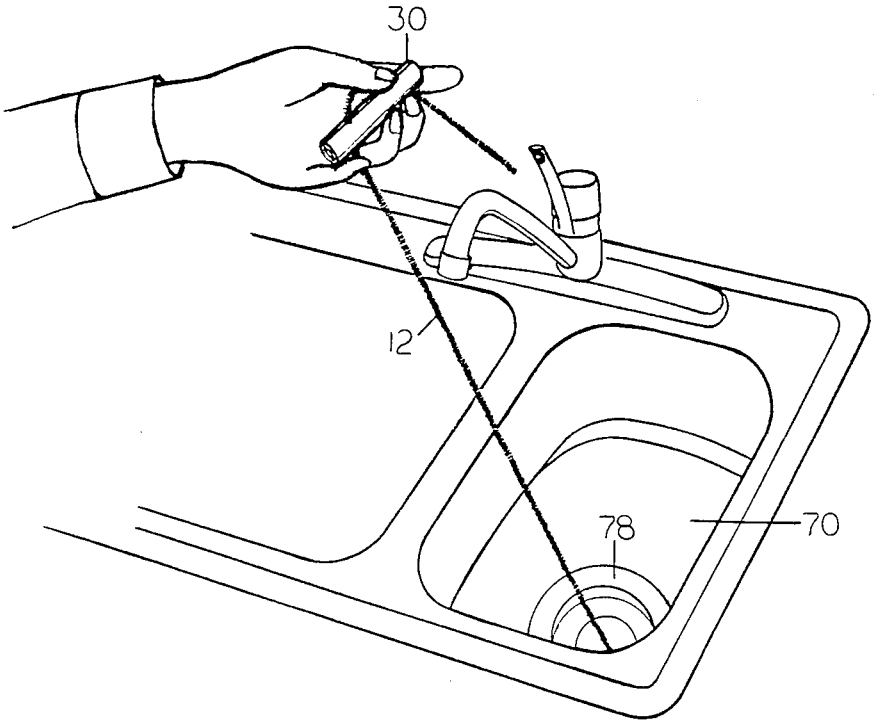
FIG. 4 represents a perspective view of a powered conduit cleaning apparatus being removed from a drain conduit after either normal usage or in the event of lodging.

Drive end 14 of coil member 12 is inserted through aperture 34B, 34A, 32A, and 32B of first coil guide means 30 which acts in a second capacity as a means for gripping coil member 12 for removal from trap 72 or drain pipe 74 through drain aperture 78 of sink 70 as shown in FIG. 4. This method of removal is especially helpful when cleaning member 20 or coil member 12 is difficult to remove.

I claim:

1. A power conduit cleaning apparatus for use in cleaning, removing and dislodging obstructions in pipes, drains, thermos bottles and other like conduits comprising:

a flexible drive means being a flexible coil having drive and driven ends;

a cleaning means being a brush crimped to said driven end of said flexible drive means;

a rotational power means engaged to said drive end for said axial rotation of said flexible drive means and said cleaning means;

a guide means used to direct said flexible drive means consisting of a first coil means constructed of tubular material for receiving therethrough said flexible drive means during operation of said power conduit cleaning apparatus;

a second coil guide means approximately twice in length over said first coil guide means constructed from said tubular material for receiving therethrough said flexible drive means during operation of said power conduit cleaning apparatus;

a third coil guide means for approximately 10 percent more length over said second coil guide means constructed from said tubular material for receiving therethrough said flexible drive means during operation of said power conduit cleaning apparatus; wherein said first coil guide means, said second coil guide means and said third coil guide means are used alternatively depending on depth of penetration desired of said flexible drive means.

2. A power conduit cleaning apparatus for self-contained safety and storage comprising:

a flexible coil having attached to a driven end thereof a brush;

a first coil guide means constructed from tubular material, having therein a first end set of diametrically opposed apertures, a second middle set of diametrically opposed apertures and a third end set of diametrically opposed apertures for insertion therein of said flexible coil;

a second coil guide means approximately twice in length over said first coil guide means constructed from said tubular material for receiving therethrough said flexible coil during storage, having therein a first end set of diametrically opposed apertures and a second end set of diametrically opposed apertures having use as aforesaid but not during storage;

a third coil guide means of approximately 10 percent more length over said second coil guide means constructed from said tubular material for receiving therethrough said flexible coil during storage, having therein a first end set of diametrically opposed apertures and a second end set of diametrically opposed apertures having use as aforesaid but not during storage.

3. A power conduit cleaning apparatus according to claim 2 wherein said flexible coil is inserted through said secod middle set of diametrically opposed apertures of said first coil guide means, said flexible coil is then inserted through said third coil guide means lengthwise, likewise through said second coil guide means lengthwise, said end of said flexible coil is then inserted through said first end set of diametrically opposed apertures of said first coil guide means, said flexible coil is then looped at approximately a 90 degree angle and inserted back through said third end set of diametrically opposed apertures of said first coil guide means to form a storage configuration.

4. A power conduit cleaning apparatus for use in cleaning, removing, and dislodging obstructions in pipes, drains, thermos bottles, and other like conduits comprising:

a flexible drive means consisting of a flexible coil having drive and driven ends;

a cleaning means fixed to said driven end and consisting of a brush crimped to said driven end of said flexible drive means for removal of said obstructions and for efficient removal of sediment located on the inside diameter of said pipes, drains, thermos bottles and other like conduits;

a rotational power means engaged to said drive end for aixal rotatin of said flexible drive means and said cleaning means;

a guide means capable of surrounding variable lengths of said flexible drive means during operation to prevent snarling and provide safety consisting of a first coil guide means constructed from tubular material, having therein a first end set of diametrically opposed apertures, a second middle set of diametrically opposed apertures and a third end set of diametrically opposed apertures for retrieving said first coal guide means with a hook-like instrument when said first coil guide means is inadvertently dropped into said pipe, drain, thermos bottle, or other like conduit;

a second coil guide means approximately twice in length over said first coil guide means constructed from said tubular material, having therein a first end set of diametrically opposed apertures and a second end set of diametrically opposed apertures for retrieving said second coil guide means with said hook-like instrument when said second coil guide means is inadvertently dropped into said pipe, drain, thermos bottle, or other like conduit;

a third coil guide means of approximately 10 percent more length over said second coil guide means constructed from said tubular material, having therein a first end set of diametrically opposed apertures and a second end set of diametrically opposed apertures for retrieving said third coil guide means with said hook/like instrument when said third coil guide means is inadvertently dropped into said pipe, drain, thermos bottle, or other like conduit.

5. A power conduit cleaning apparatus for use in cleaning, removing, and dislodging obstructions in pipes, drains, thermos bottles, and other like conduits comprising:

a flexible drive means consisting of a flexible coil having drive and driven ends;

a cleaning means fixed to said driven end and consisting of a brush crimped to said driven end of said flexible drive means for removal of said obstructions and for efficient removal of sediment located on the inside diameter of said pipes, drains, thermos bottles and other like conduits;

a rotational power means engaged to said drive end for axial rotation of said flexible drive means and said cleaning means;

a guide means used to direct said flexible drive means consisting of a first coil guide means constructed of tubular material for receiving therethrough said flexible drive means during operation of said power conduit cleaning apparatus;

a second coil guide means approxiamtely twice in length over said first coil guide means constructed from said tubular material for receiving therethrough said flexible drive means during operation of said power conduit cleaning apparatus;

a third coil guide means of approximately 10 percent more length over said second coil guide means constructed from said tubular material for receiving therethrough said flexible drive means during operation of said power conduit cleaning apparatus; wherein said first coil guide means, said second coil guide means and said third coil guide means are used alternatively depending on depth of penetration desired of said flexible drive means.

* * * * *